US006709180B2

(12) United States Patent
Cochran

(10) Patent No.: US 6,709,180 B2
(45) Date of Patent: Mar. 23, 2004

(54) ERGONOMIC WAX PEN

(76) Inventor: Katherine J. Cochran, 1716 Rutledge Rd., Longwood, FL (US) 32779

( * ) Notice: Subject to any disclaimer, the term of this patent is extended or adjusted under 35 U.S.C. 154(b) by 59 days.

(21) Appl. No.: 10/226,046

(22) Filed: Aug. 21, 2002

(65) Prior Publication Data

US 2004/0037608 A1 Feb. 26, 2004

(51) Int. Cl.[7] ..... A46B 11/08; B43K 23/02; B43M 11/06

(52) U.S. Cl. ..... 401/1; 401/183; 401/131; 219/201; 219/221; 219/227; 222/105; 222/146.5

(58) Field of Search ..... 401/1, 183, 184, 401/185, 186, 131, 2, 190; 219/200, 201, 221, 227; 222/92, 105, 106, 146.1, 146.5

(56) References Cited

U.S. PATENT DOCUMENTS

| | | | | | |
|---|---|---|---|---|---|
| 1,109,034 | A | * | 9/1914 | Bryan | 401/2 |
| 4,218,152 | A | * | 8/1980 | Sloan | 401/2 |
| 4,465,073 | A | | 8/1984 | Schwob | |
| 4,712,589 | A | | 12/1987 | De Gaspari | |
| 4,859,105 | A | * | 8/1989 | Davis et al. | 401/286 |
| 5,236,269 | A | * | 8/1993 | Handy | 401/1 |
| 5,346,394 | A | | 9/1994 | DeStefanis | |
| 5,368,199 | A | | 11/1994 | Haas et al. | |
| 5,395,175 | A | | 3/1995 | Bontoux et al. | |
| 5,831,245 | A | * | 11/1998 | Debourg et al. | 219/242 |
| 5,848,850 | A | | 12/1998 | Bontoux et al. | |
| 5,873,666 | A | | 2/1999 | Bourke et al. | |
| 5,902,060 | A | | 5/1999 | Rodriguez | |
| 5,980,536 | A | | 11/1999 | Jamali | |
| 6,039,482 | A | | 3/2000 | Smal | |
| 6,053,649 | A | | 4/2000 | Ronai | |
| 6,076,984 | A | | 6/2000 | Legrain et al. | |
| 6,255,625 | B1 | | 7/2001 | Baschenis | |
| 6,273,625 | B1 | | 8/2001 | Martinez de San Vincente Oliveras | |

* cited by examiner

*Primary Examiner*—David J. Walczak
(74) *Attorney, Agent, or Firm*—Edward M. Livingston, Esq.

(57) ABSTRACT

An ergonomic wax pen has an ergonomic case (1) with optionally finger-squeeze control of pressure to force out molten wax (7) from a wax chamber (6) through an extrusion nozzle at an extrusion end (3) to which predetermined application tips (21, 24, 25, 26, 27, 28) can be attached for predetermined wax applications. The ergonomic case includes a contoured taper from a major periphery (2) proximate the extrusion end to an oppositely disposed minor periphery (4) that is proximate a base end (5). A wax heater (10, 18, 19) is positioned externally from the wax chamber which is pressurized selectively with a pressurizer. The base end can include an orthogonal base plate (11) on which the ergonomic case can be positioned uprightly when not in use and with which the ergonomic case can be prevented from rolling when laid down. The contour of the ergonomic case can be optimized for ergonomic handling with finger-controllable size and shape of the major periphery in structural relationship to a smaller and lighter portion of the minor periphery. The minor-periphery portion can be oriented upwards or supported by a user's hand selectively when extruding molten wax. A heat gauge (61) and a wax-level window (62) can be provided on the ergonomic case. The wax heater can be energized internally with electrical resistance or externally with microwave heat. The pressurizer can include a hand-squeezable ergonomic case, a pneumatic hand pump (46) or a remote air compressor (57).

24 Claims, 7 Drawing Sheets

FIG. 1
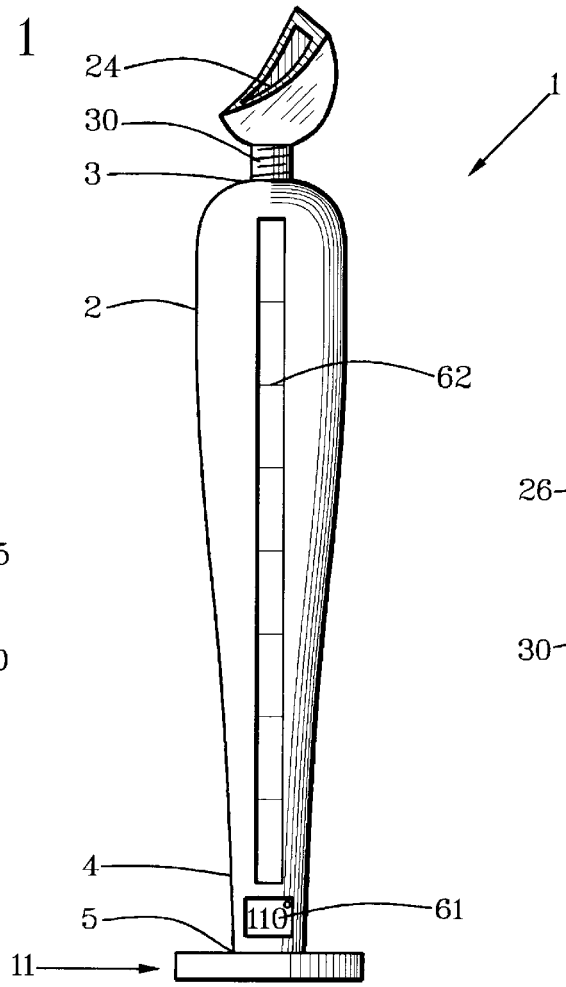
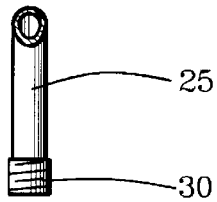
FIG. 2
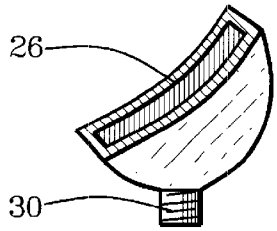
FIG. 3
FIG. 4
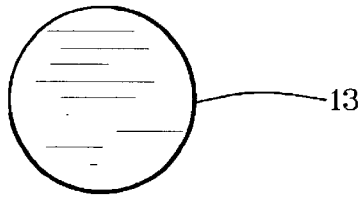
FIG. 5
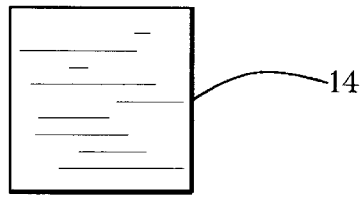

ERGONOMIC WAX PEN

BACKGROUND OF THE INVENTION

This invention relates to ergonomic finger-held wax dispensers used for depilatory hair removal, dentistry molding, jewelry design, sculpting and other applications requiring finely controlled extrusion of molten wax.

Hand-held and finger-held extruders of molten wax are well-known tools for depilatory hair removal, dentistry molding, jewelry design and other applications. An industry has evolved for supplying a variety of wax sticks and rope for different sizes and different constituents of wax used for the different applications. None, however, provide an ergonomically tapered, finger-squeezable, easily heatable, lightweight and versatile adaptive wax pen in a manner taught by this invention. Although intended to be advantageous for many applications, a typical use is for depilatory hair removal.

Examples of most-closely related known but different devices are described in the following patent documents:

| U.S. Pat. No. | Inventor | Date |
|---|---|---|
| 6,255,625 | Baschenis | 07-03-2001 |
| 4,465,073 | Schwob | 08-14-1984 |
| 5,368,199 | Haas, et al. | 11-29-1994 |
| 5,346,394 | DeStefanis | 09-13-1994 |
| 5,848,850 | Bontoux, et al. | 12-15-1998 |
| 4,712,589 | De Gaspari | 12-15-1987 |
| 4,218,152 | Sloan | 08-19-1980 |
| 5,395,175 | Bontoux, et al. | 03-07-1995 |
| 6,039,482 | Smal | 03-21-2000 |
| 5,980,536 | Jamali | 11-09-1999 |
| 6,273,625 | Martinez de San Vincente Oliveras | 08-14-2001 |
| 6,076,984 | Legrain, et al. | 06-20-2000 |
| 6,053,649 | Ronai | 04-25-2000 |
| 5,902,060 | Rodriguez | 05-11-1999 |
| 5,873,666 | Bourke, et al. | 02-23-1999 |

Some of the previous wax extruders have required a compressed-air source that is not readily available for home use, for traveler use or for beauty-shop use. Many have inadequately controllable roll-on extrusion. All have been either too bulky or not structured for artistic finger handling. None have had an ergonomic configuration which enhances hand control, diminishes fatigue and enables use by various-stage arthritics that are quite common. None have been easily heatable in homes, in travel, in dental care, in jewelry construction or in other applications of wax extrusion. All have fundamental differences from this invention.

SUMMARY OF THE INVENTION

Objects of patentable novelty and utility taught by this invention are to provide an ergonomic wax pen which:

- does not require a compressed-air source for home and travel applications where compressed air is not readily available;
- includes finger-pumping and motorized-pumping embodiments for professional, high-skill and high productivity applications;
- is not too bulky for artistic finger handling;
- has an ergonomic configuration which enhances finger-holding for skillful use and which diminishes fatigue;
- is easily heatable in homes and in travel;

- readily accepts application tips for most applications; avoids leakage drip of molten wax;
- is easily cleaned and maintained;
- has precisely controllable output, and
- is readily transportable and storable for personal use.

This invention accomplishes these and other objectives with an ergonomic wax pen having an ergonomic case with finger-squeeze control of pressure to force out molten wax from a wax chamber through a wax-extrusion nozzle at an extrusion end to which predetermined application tips can be attached for predetermined wax applications. The ergonomic case includes a contoured taper from a major perimeter proximate the extrusion end to an oppositely disposed minor perimeter that is proximate a base end. A wax heater is positioned externally from the wax chamber which is pressurized selectively with a pressurizer. The base end can include an orthogonal base plate on which the ergonomic case can be positioned uprightly when not in use and with which the ergonomic case can be prevented from rolling when laid down. The contour of the ergonomic case can be optimized for ergonomic handling with finger-controllable size and shape of the major perimeter in structural relationship to a smaller and lighter portion of the minor perimeter. The minor-perimeter portion can be oriented upwards or supported by a user's hand selectively when extruding wax. A heat gage and a wax-level window can be provided on the ergonomic case. The wax heater can be energized internally with electrical resistance or externally with microwave heat. The pressurizer can include a hand-squeezable ergonomic case, a pneumatic hand pump or a motorized pump.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 1 is a side elevation view of a microwave-heatable embodiment of the ergonomic wax pen in which a depilatory application tip for lip-hair removal is positioned;

FIG. 2 is a side elevation view of an eyebrow depilatory tip for use in the ergonomic wax pen;

FIG. 3 is a perspective view of a chin and other-area depilatory tip for use in the ergonomic wax pen;

FIG. 4 is a bottom view of the ergonomic wax pen having a circular base plate;

FIG. 5 is a bottom view of the ergonomic wax pen having a square base plate;

DESCRIPTION OF PREFERRED EMBODIMENT

Figure 9:
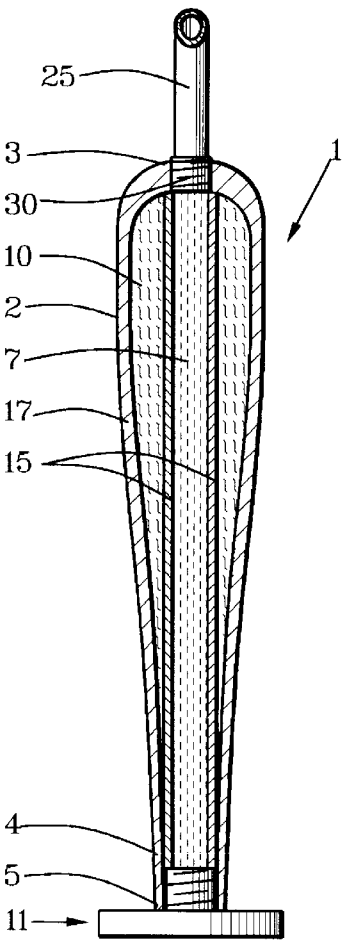
FIG. 9 is a partially cutaway elevation view of the FIG. 8 illustration in which the wax rod is melted into molten wax and a depilatory tip representative of application tips generally is positioned.

Listed numerically below with reference to the drawings are terms used to describe features of this invention. These terms and numbers assigned to them designate the same features throughout this description.

1. Ergonomic case
2. Major periphery
3. Extrusion end
4. Minor periphery
5. Base end
6. Wax chamber
7. Molten wax
8. Waxrod
9. Outlet aperture
10. Case sides
11. Base plate
12. Source platform
13. Round base plate
14. Rectangular base plate
15. Chamber walls
16. Fixed chamber walls
17. Insulating cover
18. Linear wire
19. Helical wire
20. Electrical connection
21. Dedicated nozzle
23. Screw thread
24. Lip tip
25. Eyebrow tip
26. Chin tip
27. Pointed tip
28. Broad tip
29. Storage case
30. Mating screw thread
31. Pressurizer piston
32. One-way inlet valve
33. Inlet valve spring
34. Internal threads
35. Valve-attachment structure
36. Valved extrusion nozzle
37. Case-attachment structure
38. Flow-control valve
39. Valve inlet aperture
40. Valve outlet aperture
41. Nozzle outlet aperture
42. Valve plunger
43. Plunger sleeve
44. Squeeze member
45. Extrusion spring
46. Hand pump
47. Spring-return piston
48. Pump plunger
49. Inlet valve
50. Ambient aperture
51. Plunger tube
52. Pressure inlet
53. Valve chamber
54. One-way valve
55. Plunger tube
56. Pressure adaptor
57. Remote air compressor
58. Pressure conveyance
59. Current adaptor
60. Electrical conduit
61. Heat gauge
62. Wax-level window
63. Nozzle threads Referring to FIGS. 1–14, the ergonomic wax pen includes an ergonomic wax case 1 having a contoured taper intermediate a major periphery 2 proximate an extrusion end 3 and a minor periphery 4 proximate a base end 5. The contoured taper is structured for ergonomic finger-and-thumb handling of a size and shape of a major-periphery portion in structural relationship to a smaller and lighter minor-periphery portion that can be oriented selectively or supported by a user's hand when in use.

Figure 8:
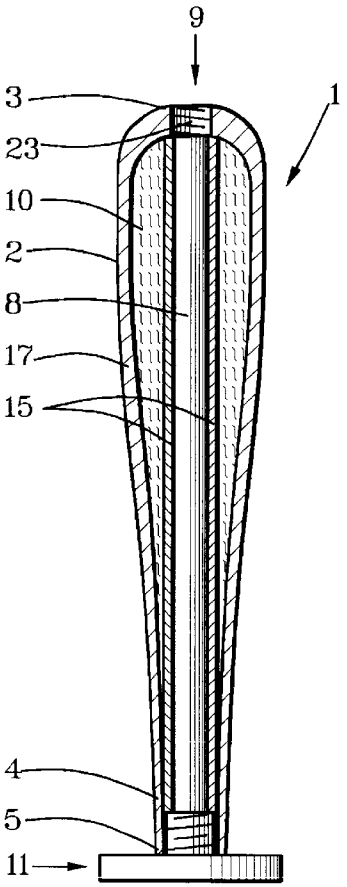
FIG. 8 is a partially cutaway elevation view of the FIG. 6 illustration in which a wax rod is positioned.

A wax chamber 6 is positioned predeterminedly intermediate the base end 5 and the extrusion end 3 of the ergonomic case 1. A wax heater is positioned externally from the wax chamber 6 for melting wax into molten wax 7 in the wax chamber 6 from commercially supplied wax rod 8 as shown in FIG. 8. before being melted into the molten wax 7 shown in FIGS. 9–11, 13–14 and 20–21. The wax chamber 6 has an outlet aperture 9 proximate an extrusion end of the wax chamber 6. The wax pen may be refillable for reuse or made disposable for one-time use.

The wax heater for melting wax in the wax chamber 6 in the embodiments shown in FIGS. 1, 6–14 and 23–24 includes case sides 10 that are finger-squeezable resilient and microwave tolerant for being also an extrusion pressurizer for applying extrusion pressure for forcing the molten wax 7 out of the wax chamber 6 through the outlet aperture 9.

An extrusion nozzle is positioned proximate the outlet aperture 9. The extrusion nozzle includes an application tip that can be attached removably to render the ergonomic wax pen useable for wax extrusion generally or that can be attached permanently for dedicated uses. Depilatory use of the ergonomic wax pen is shown primarily, but dental, jewelry and artistic uses are equally intended, applicable and foreseeable.

A base plate 11 proximate the base end 5 is orthogonal to an axis of the ergonomic case 1. The base plate 11 is an upright stand which eliminates nozzle molten-wax leaks for hand-squeezable embodiments and diminishes it for pneumatic-pressured embodiments. In addition, upright positioning with the base plate 11 enhances ease of use, provides a pneumatic connection to a source platform 12 shown in FIGS. 18–21 as described later. The base plate 11 can be a round base plate 13 as shown in FIG. 4 or a rectangular base plate 14 as shown in FIG. 5. The rectangular base plate 14 prevents rolling when the ergonomic pen is laid down horizontally.

Sizes and proportions of the major periphery 2 and the minor periphery 4 of the ergonomic wax pen can be varied for different users and for different uses. It is recommended that a plurality of sizes and proportions, preferably at least three variations, be manufactured and marketed for different applications and for users with different hand sizes and sense of control of the ergonomic wax pen.

Generally but not necessarily, therefore, the major periphery 2 of the contoured taper of the ergonomic case 1 includes a predetermined cross-sectional distance within a range of one-half-to-one inch. The minor periphery 4 of the contoured taper of the ergonomic case 1 includes a predetermined cross-sectional distance within a range of one-quarter-to-three-eighths of one inch. The contoured taper of the ergonomic case 1 has a length within a range of three-to-eight inches intermediate a largest peripheral portion of the major periphery 2 and a smallest peripheral portion of the minor periphery 4. A preferred cross-sectional distance of the base plate 11 is slightly longer than a cross-sectional distance of the widest portion of the major periphery 2.

For the embodiment of the ergonomic wax pen having a pressurizer that employs finger-squeeze pressurization of the molten wax 7 as shown in FIGS. 1, 6–17 and 23–24, the ergonomic case 1 proximate the wax chamber 6 includes case sides 10 that are resilient. The wax chamber 6 is structured to receive a predetermined wax rod 8 through a base-plate end of the wax chamber 6. The base plate 11 includes sealing engagement with the base end of the wax chamber 6 with detachable attachment of the base plate 11 to the base end 5 of the ergonomic case. 1. The ergonomic case 1 includes chamber walls 15 of the wax chamber 6 that are microwave tolerant for transferring microwave heat to the wax rod 8 in the wax chamber 6.

Figure 7:
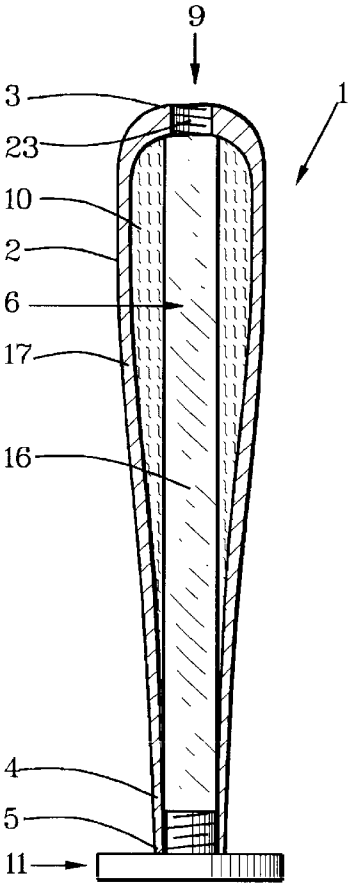
FIG. 7 is a partially cutaway elevation view of the FIG. 6 illustration showing walls orthogonally disposed from the walls that are pressured inwardly.
Figure 6:
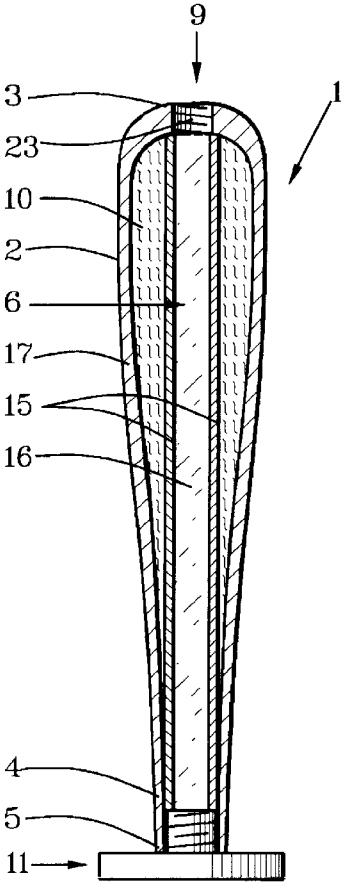
FIG. 6 is a partially cutaway elevation view of the microwave-heatable ergonomic wax pen showing oppositely disposed straight walls that are pressured inwardly for finger-squeeze pressurization.
Figure 10:
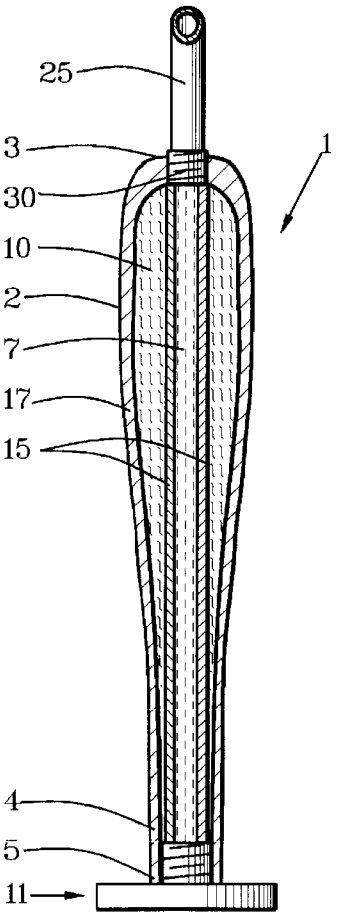
FIG. 10 is a partially cutaway elevation view of the FIG. 9 illustration with sides squeezed in part way and part of the molten wax having been squeezed out.
Figure 11:
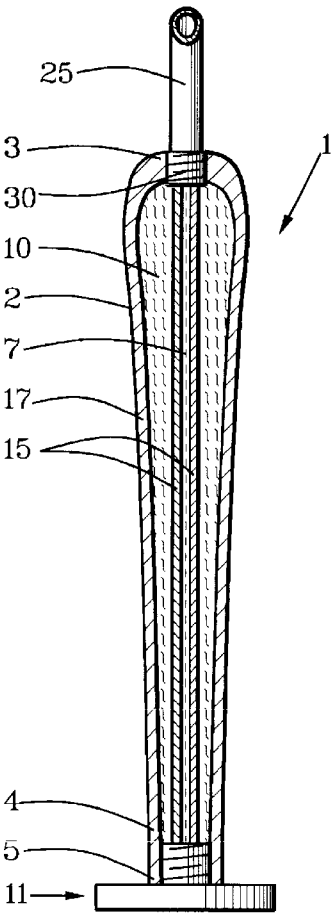
FIG. 11 is a partially cutaway elevation view of the FIG. 10 illustration with sides squeezed in nearly all of the way and nearly all of the molten wax having been squeezed out.
Figure 12:
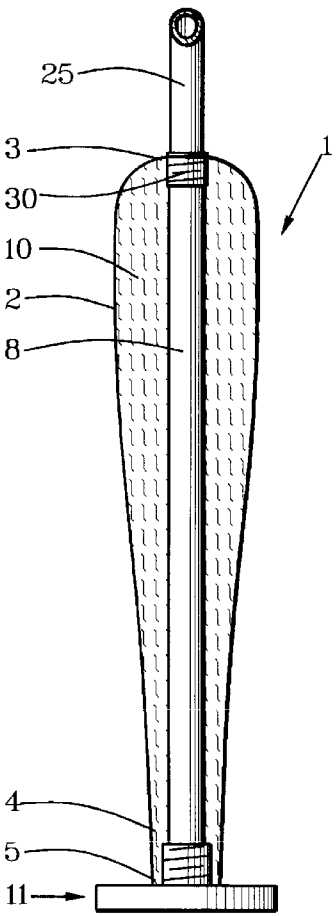
FIG. 12 is a partially cutaway elevation view of the microwave-heatable ergonomic wax pen having pliable and resilient sides that are pressured inwardly for finger-squeeze pressurization and having a wax rod positioned in it.
Figure 13:
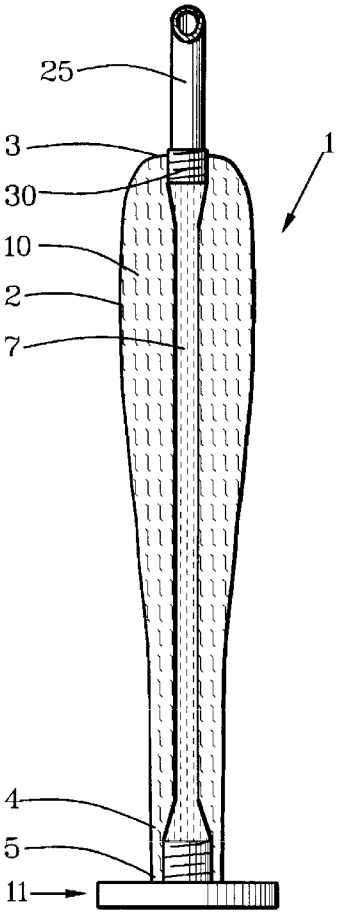
FIG. 13 is a partially cutaway elevation view of the FIG. 12 illustration showing the pliable and resilient sides squeezed partly inward against molten wax.

Optionally, the chamber walls 15 can include two oppositely disposed walls that are forced inwardly between fixed chamber walls 16 as shown in FIGS. 6–7 for finger-squeeze pressurization.

As shown in FIGS. 6–11, an insulating cover 17 on the ergonomic case 1 can be included, particularly for embodiments that microwave-heat the wax rod 8.

Figure 16:
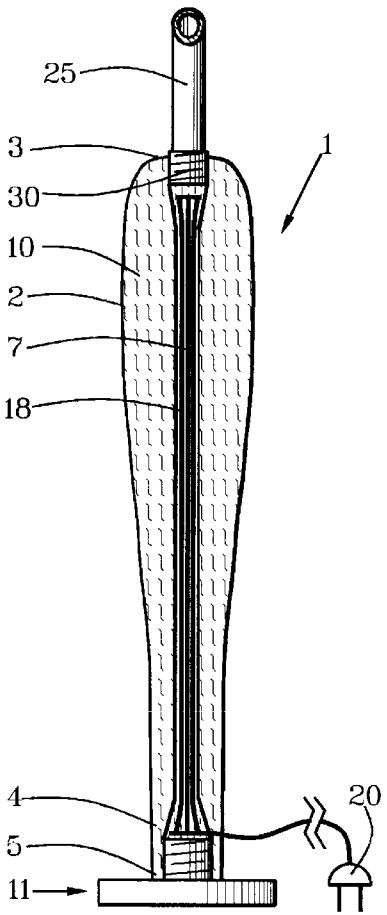
FIG. 16 is a side elevation view of the FIG. 15 illustration in which the sides are squeezed in part way and the linear resistance members are bent inwardly.
Figure 15:
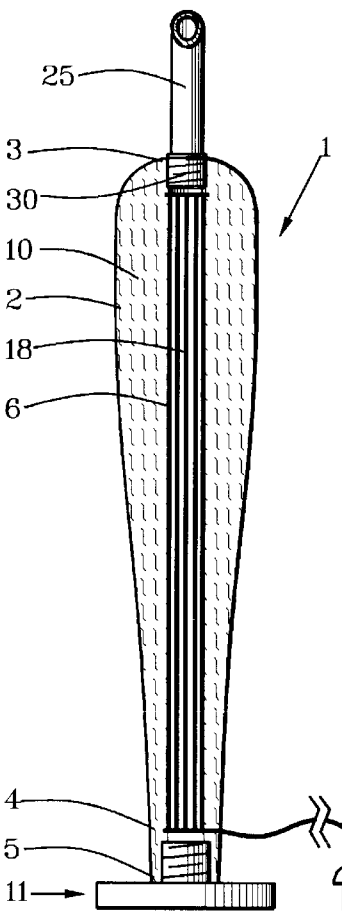
FIG. 15 is a partially cutaway side elevation view of a resistance-heatable embodiment of the ergonomic wax pen in which resistance members are linear for ease of being squeezed inwardly and sides are pliable and resilient.
Figure 14:
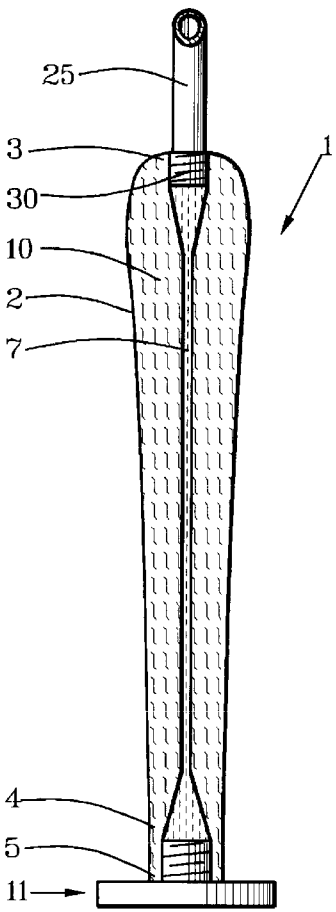
FIG. 14 is a partially cutaway elevation view of the FIG. 13 illustration with the pliable and resilient sides squeezed in nearly all of the way and nearly all of the molten wax squeezed out.
Figure 19:
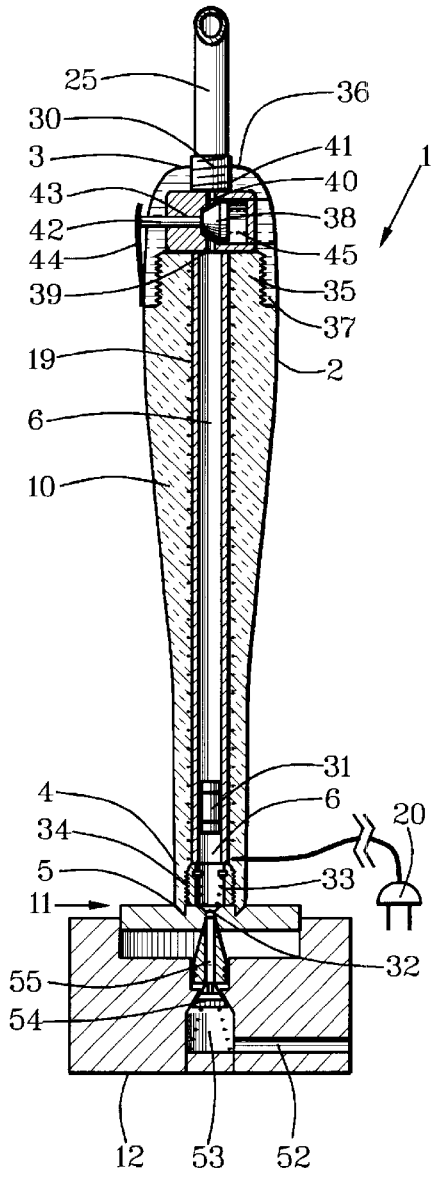
FIG. 19 is a side elevation view of a resistance-heatable and air-pressurized embodiment of the ergonomic wax pen on a source platform having a transfer valve for a remote motorized air pump.
Figure 20:
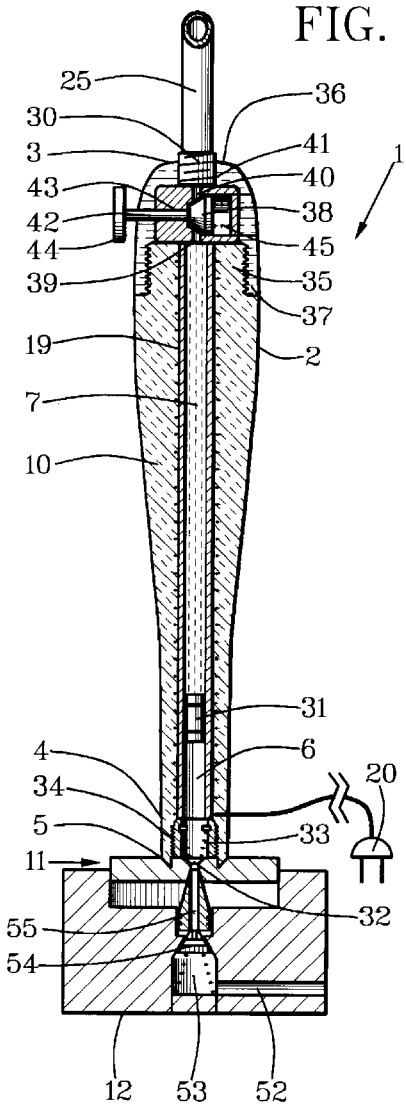
FIG. 20 is a side elevation view of the FIG. 19 illustration from which molten wax has been forced out with air pressure against a piston.
Figure 21:
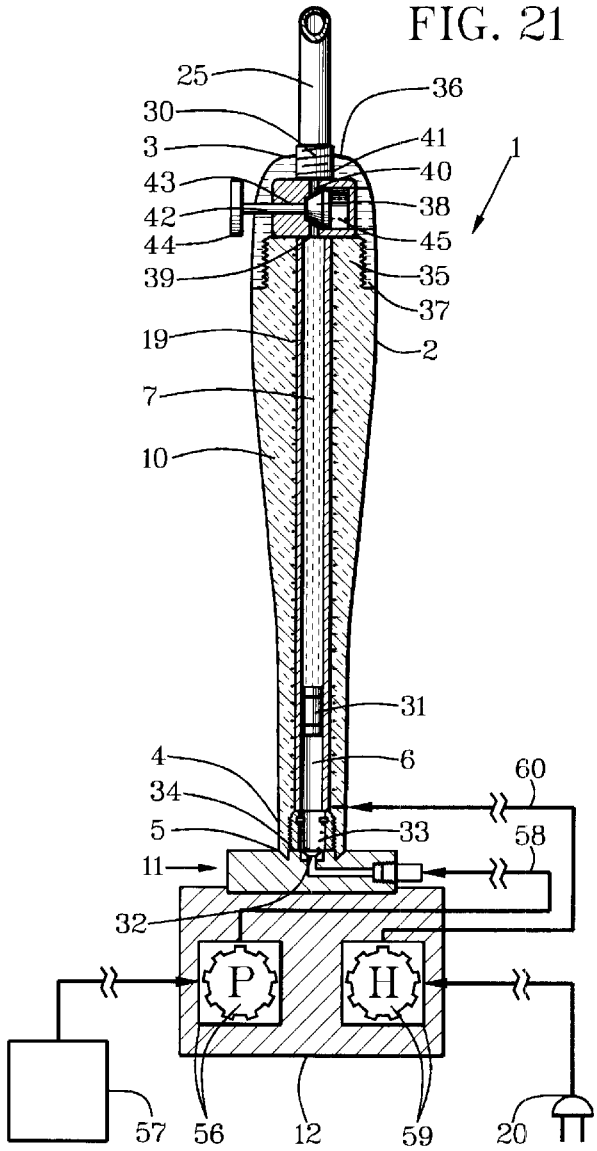
FIG. 21 is a side elevation view of the ergonomic wax pen with the source platform for controlling both pressure and heat for communication to the ergonomic pen through parallel lines that are shown schematically.

Referring to FIGS. 15–16 and 19–21, the case sides 10 can include electrical-resistance material for resistance heating the wax chamber 6 to melt the wax rod 8. For finger-squeeze embodiments having resistance heating, as shown in FIGS. 15–16, the electrical-resistance material can include linear wire 18 that is pliable linearly along the wax chamber 6 for allowing inward-squeeze pressure to be applied to the case sides 10 proximate the wax chamber 6 and to the electrical-resistance material. For rigid-case embodiments having resistance heating material as shown in FIGS. 19–21, the electrical-resistance material can include helical wire 19 that is not squeezed inwardly.

The ergonomic case 1 includes an electrical connection 20 for transmission of electrical current to whatever form or shape of the electrical-resistance material may be employed for receiving current from an electrical source.

Figure 22:
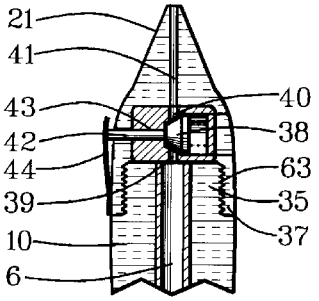
FIG. 22 is a partially cutaway fragmentary side view of the extrusion nozzle that includes a dedicated nozzle for directing flow of the molten wax without attachment of an application tip and which is attached detachably to the extrusion end of the ergonomic case having rigid walls for pneumatic pressurization.
Figure 23:
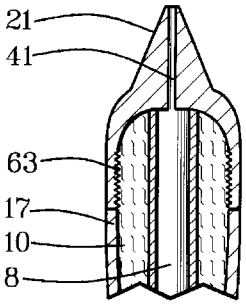
FIG. 23 is a partially cutaway fragmentary side view of the extrusion nozzle that includes configuration for directing flow of the molten wax without attachment of an application tip and which is attached detachably to the extrusion end of the ergonomic case that is hand squeezable.
Figure 24:
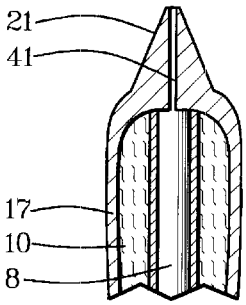
FIG. 24 is a partially cutaway fragmentary side view of the extrusion nozzle that includes configuration for directing flow of the molten wax without attachment of an application tip and which is an integral part of the extrusion end of the ergonomic case that is hand squeezable.

Referring to FIGS. 22–24, the extrusion nozzle can include a dedicated nozzle 21 having predetermined configuration for directing flow of the molten wax 7 from the wax chamber 6. The dedicated nozzle 21 can be structured for a particular application for users who do not prefer a variety of application tips or who prefer a particular form of the dedicated nozzle 21. A plain conical tip is illustrated to represent either of a variety of applications for which the dedicated nozzle 21 can be structured. It can be used on either form of pressurization and wax-heating or on any combination thereof that is made possible by the ergonomic wax pen. The dedicated nozzle 21 also can be attached detachably with nozzle threads 63 as depicted in FIGS. 22–23 or affixed permanently as depicted in FIG. 24.

Figure 25:
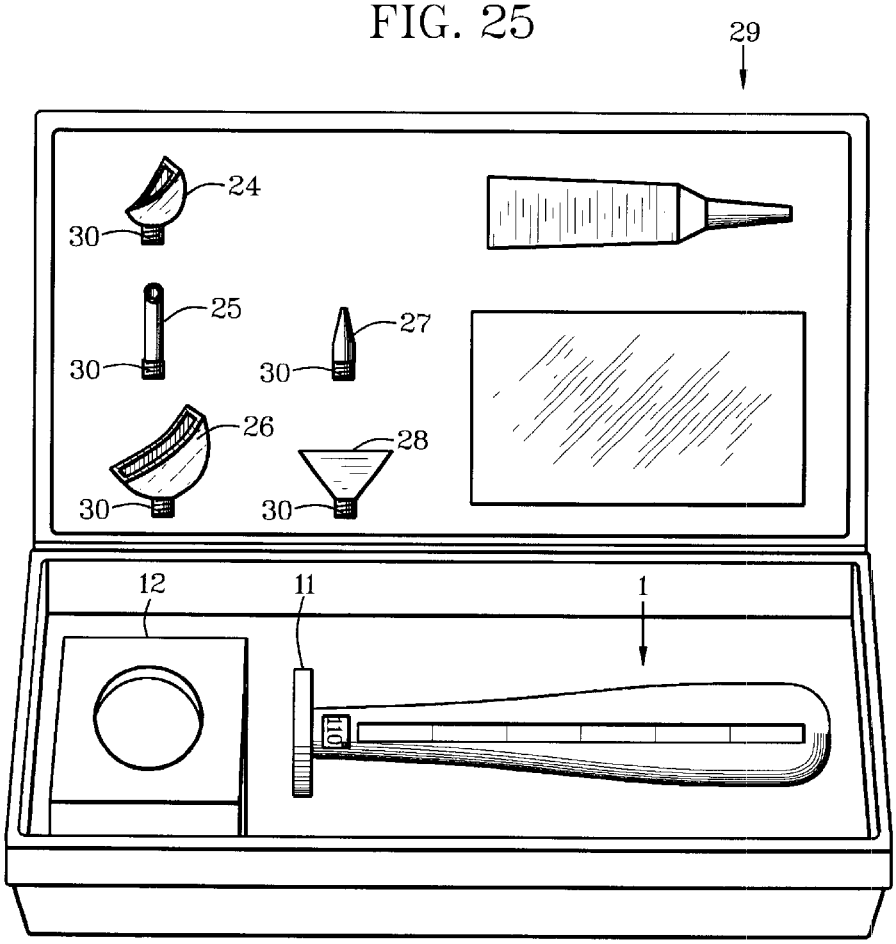
FIG. 25 is a perspective view of the ergonomic wax pen in a compact container for optionally travel, convenient storage or sales packaging.

Referring to FIGS. 6–16 and 18–22, the outlet aperture 9 can include screw thread 23 or other attachment structure for attachment of application tips having predetermined configuration for directing flow of the molten wax 7. Jewelry, dentistry and art application tips are represented by depilatory tips that include a lip tip 24 having an arcuately faced triangular outlet as shown in FIGS. 1 and 25, an eyebrow tip 25 having a slanted circular outlet as shown in FIGS. 2, 9–21 and 25, and a chin tip 26 having an arcuately faced rectangular outlet as shown in FIGS. 3 and 25. The eyebrow tip 25 is shown with the embodiments in FIGS. 9–21 for representing application tips generally. A pointed tip 27 and a broad tip 28 are shown in a storage case 29 in FIG. 25 as also representative of application tips generally.

Application tips can have mating screw thread 30 for being screwed into the screw thread 23 as depicted in FIGS. 1–3, 9–21 and 25.

Referring to FIGS. 18–21, embodiments of the ergonomic wax pen having pneumatic pressurization include the ergonomic case 1 and walls of the wax chamber 6 that are rigid. The wax chamber 6 is structured to receive the wax rod 8 and a pressurizer piston 31 through either end of the wax chamber 6. This allows the wax chamber 6 to be cleaned easily when needed and allows easy access to the pressurizer piston 31 by blowing it through or pushing it through the wax chamber with the wax rod 8 or with a pencil-like instrument.

The pressurization piston 31 has sliding-seal contact with an inside periphery of the wax chamber 6. The base plate 11 includes a one-way inlet valve 32 in inlet-valve communication from a source of compressed air to the wax chamber 6. The one-way inlet valve 32 can include a small coned member that is pressured against a valve seat with an inlet valve spring 33 that preferably is a conically helical spring that is anchored upwardly as shown. The source of compressed air preferably includes the source platform 12 on which the base plate 11 rests in a horizontal orientation with the ergonomic case 1 in an upright orientation in a non-use mode.

The minor periphery 4 of the ergonomic case 1 preferably includes internal threads 34 that mate with threads on a valve sleeve extended from the base plate 11 proximate an entrance to the wax chamber 6 for attaching the base plate 11 in sealing contact with the base end 5 of the wax chamber 6.

The extrusion end 3 of the ergonomic case 1 includes nozzle-attachment threads on valve-attachment structure 35 for attachment of a valved extrusion nozzle 36. The valved extrusion nozzle 36 includes mating threads on case-attachment structure 37 for attachment to the extrusion end 3 of the ergonomic case 1.

The valved extrusion nozzle 36 includes a flow-control valve 38 that is finger-squeeze controllable for allowing squeeze-released amounts of molten wax 7 to egress and to prevent ingress of the molten wax 7 through the valved extrusion nozzle 36. The flow-control valve 38 includes a truncate cone that fits in a concave cone seat as depicted. The truncate cone and the concave cone seat have concentric axes that are orthogonal to an axis of the ergonomic case 1. The concave cone seat includes a valve inlet aperture 39 in fluid communication from the wax chamber 6 and a valve outlet aperture 40 in fluid communication from the concave cone seat to a nozzle outlet aperture 41 in the dedicated nozzle 21 or into nozzle outlet aperture 41 having screw thread 23 into which application tips having mating screw thread 30 are screwed. The valve inlet aperture 39 and the valve outlet aperture 40 have axes that are orthogonal to the axes of the truncate cone and the concave cone seat.

The truncate cone includes a valve plunger 42 extended axially from a truncate end of the truncate cone. The valve plunger 42 is in sliding-seal contact with an inside periphery of a plunger sleeve 43. A squeeze member 44 is positioned proximate a terminal end of the valve plunger 42. The truncate cone is spring-pressured in a direction of the squeeze member 44 with an extrusion spring 45.

The valve outlet aperture 40 includes predetermined configuration for directing flow of the molten wax from the valved extrusion nozzle 36.

The predetermined configuration for directing flow of the molten wax from the valved extrusion nozzle 36 includes the screw thread 23 shown in FIGS. 6–8 for attachment of predetermined application tips.

The ergonomic case 1 and the walls of the wax chamber 6 can be microwave tolerant for transferring microwave heat to the wax rod 8 in the wax chamber 6 from a microwave oven which is not shown. Optionally, the walls of the wax chamber 6 can include electrical-resistance material for resistance heating the wax chamber 6 to melt the wax rod 8. For resistance heating, the ergonomic case 1 includes the electrical connection 20 for transmission of electrical current to the electrical-resistance material from an electrical source.

The wax chamber 6 preferably includes compressed-air space intermediate the pressurizer piston 31 and the base end 5 of the wax chamber 6 for containing an amount of air pressure from the source of compressed air for forcing the pressurizer piston 31 against the molten wax 7 for extruding an amount of the molten wax 7 from the wax chamber 6 through the valved extrusion nozzle 36. The amount of molten wax 7 extruded is determined by length of time, distance of squeeze of the squeeze member 44 on the valve plunger 42 and amount of air pressure in the wax chamber 6.

Figure 18:
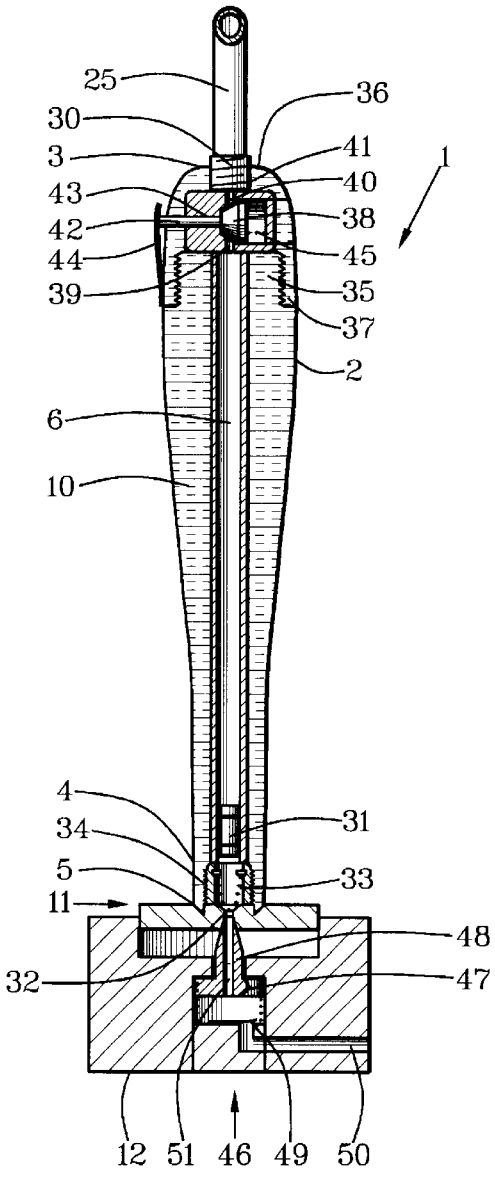
FIG. 18 is a side elevation view of a microwave-heatable and air-pressurized embodiment of the ergonomic wax pen on a source platform having a hand pump and a finger-squeezable extrusion nozzle.

As shown in FIG. 18, the source of compressed air can include a hand pump 46 having a spring-return piston 47 that is attached to a pump plunger 48 that can be engaged by the base plate 11 on the source platform 12. An inlet valve 49 allows inlet of air from an ambient aperture 50. Air pressured from pushing down on the ergonomic case 1 and the base plate 11 a few times when needed travels through a plunger tube 51 and past the one-way inlet valve 32 to the wax chamber 6 below the pressurizer piston 31.

As shown in FIGS. 19–20, the source of compressed air can include motorization that is remote from the source platform 12 which has a pressure inlet 52 to a valve chamber 53 having a one-way valve 54 to a plunger tube 55 in communication with the one-way inlet valve 32 for allowing remotely compressed air to enter the wax chamber 6 by downward actuation of the base plate 11 with downward pressure on the ergonomic case 1.

As shown in FIG. 21, the source of compressed air can include a pressure adaptor 56 for adapting a rate of flow of compressed air from a remote air compressor 57 to a predetermined rate of flow of the compressed air for communication from the source platform 12 to the wax chamber 6 in a predetermined pressure conveyance 58.

As shown further in FIG. 21, the source platform 12 can include a current adaptor 59 for adaptation and direction of electrical current for transmission from the electrical connection 20 in a predetermined electrical conduit 60 to the resistance heater which includes the helical wire 19 surrounding the wax chamber 6.

The pressure conveyance 58 for conveyance of the compressed air to the wax chamber 6 and the electrical conduit 60 for transmission of electrical current to the resistance heater can be sized, shaped and juxtaposed predeterminedly intermediate the source platform 12 and the ergonomic case 1 for ease and convenience of use of the ergonomic wax pen.

Figure 17:
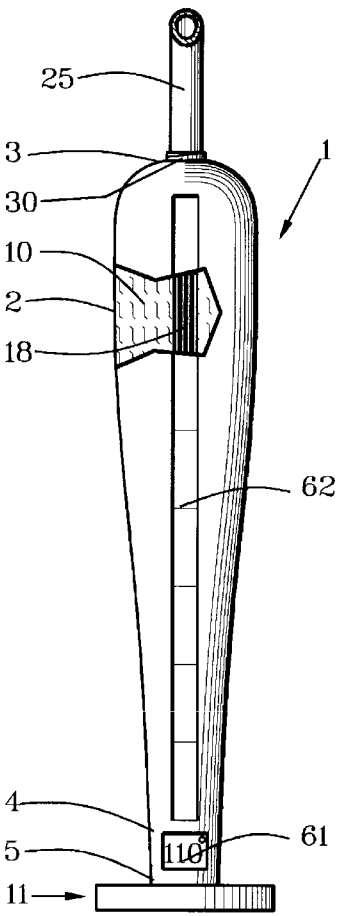
FIG. 17 is a partially cutaway side elevation view of the FIG. 15 illustration having a side window and a heat register.

Referring to FIGS. 1 and 17, the ergonomic case 1 can include a heat gauge 61 in communication with heat of the molten wax 7 in the wax chamber 6. Also included in the ergonomic case 1 can be a wax-level window 62 linearly along the wax chamber 6.

A new and useful ergonomic wax pen having been described, all such foreseeable modifications, adaptations, mathematical possibilities of combinations of parts, pluralities of parts, applications and forms thereof as described by the following claims and not precluded by prior art are included in this invention.

What is claimed is:

1. An ergonomic wax pen comprising:

an ergonomic case having a contoured taper intermediate a major periphery proximate an extrusion end and a minor periphery proximate a base end of the ergonomic case;

the contoured taper being structured for ergonomic finger-and-thumb handling of a size and shape of a major-periphery portion in structural relationship to a smaller and lighter minor-periphery portion that can be oriented selectively or supported by a user's hand when in use;

a wax chamber positioned predeterminedly intermediate the base end and the extrusion end of the ergonomic case;

a wax heater positioned externally from the wax chamber for melting wax in the wax chamber;

an outlet aperture proximate an extrusion end of the wax chamber;

an extrusion pressurizer for applying extrusion pressure for forcing the molten wax out of the wax chamber through the outlet aperture;

an extrusion nozzle positioned proximate the outlet aperture; and a base plate that is orthogonal to an axis of the ergonomic case proximate the base end thereof.

2. The ergonomic wax pen of claim 1 wherein:

the major periphery of the contoured taper of the ergonomic case includes a predetermined cross-sectional distance within a range of one-half-to-one inch;

the minor periphery of the contoured taper of the ergonomic case includes a predetermined cross-sectional distance within a range of one-quarter-to-three-eighths of one inch; and the contoured taper of the ergonomic case has a length within a range of three-to-eight inches intermediate a largest peripheral portion of the major periphery and a smallest peripheral portion of the minor periphery.

3. The ergonomic wax pen of claim 1 wherein:

the ergonomic case proximate the wax chamber includes case sides that are resilient;

the wax chamber is structured to receive a predetermined wax rod through a base-plate end of the wax chamber;

the base plate includes sealing engagement with the base end of the wax chamber with detachable attachment of the base plate to the base end of the ergonomic case.

4. The ergonomic wax pen of claim 3 wherein:

the ergoniomic case includes chamber walls of the wax chamber that are microwave tolerant for transferring microwave heat to the wax rod in the wax chamber.

5. The ergonomic wax pen of claim 3 wherein:

the case sides include electrical-resistance material for resistance-heating the wax chamber to melt the wax rod; and the ergonomic case includes an electrical connection for transmission of electrical current to the electrical-resistance material from an electrical source.

6. The ergonomic wax pen of claim 5 wherein:

the electrical-resistance material includes linear wire that is pliable linearly along the wax chamber for allowing inward-squeeze pressure to be applied to the walls of the wax chamber and to the electrical-resistance material.

7. The ergonomic wax pen of claim 1 wherein:

the extrusion nozzle includes a dedicated nozzle having predetermined configuration for directing flow of the molten wax.

8. The ergonomic wax pen of claim 1 wherein:

the extrusion nozzle includes screw thread for attachment of application tips having predetermined configuration for directing flow of the molten wax.

9. The ergonomic wax pen of claim 8 wherein:

the application tips include depilatory tips.

10. The ergonomic wax pen of claim 9 wherein:

the depilatory tips include a lip tip having an arcuately faced triangular outlet, an eyebrow tip having a slanted circular outlet, and a chin tip having an arcuately faced rectangular outlet.

11. The ergonomic wax pen of claim 1 wherein:

the ergonomic case and walls of the wax chamber are rigid;

the wax chamber is structured to receive the predetermined wax rod and a pressurizer piston through either the base-plate end or the extrusion end of the wax chamber;

the pressurizer piston has sliding-seal contact with an inside periphery of the wax chamber;

the base plate includes a one-way inlet valve in inlet-valved fluid communication from a source of compressed air to the wax chamber;

the source of compressed air includes a source platform on which the base plate rests in a horizontal orientation with the ergonomic case in an upright orientation in a non-use mode;

the minor periphery of the ergonomic case includes internal threads proximate an entrance to the wax chamber for attaching the base plate in sealing contact with the base end of the wax chamber;

the extrusion end of the ergonomic case includes nozzle-attachment threads on valve-attachment structure for attachment of a valved extrusion nozzle; and the valved extrusion nozzle includes mating threads and case-attachment structure for attachment to the extrusion end of the ergonomic case.

12. The ergonomic wax pen of claim 11 wherein:

the valved extrusion nozzle includes a flow-control valve that is finger-squeeze controllable for allowing squeeze-released amounts of molten wax to egress and to prevent ingress of the molten wax through the valved extrusion nozzle.

13. The ergonomic wax pen of claim 12 wherein:

the flow-control valve includes a truncate cone that fits in a concave cone seat;

the truncate cone and the concave cone seat have concentric axes that are orthogonal to an axis of the ergonomic case;

the concave cone seat includes a valve inlet aperture in fluid communication from the wax chamber and a valve outlet aperture in fluid communication from the concave cone seat to a nozzle outlet aperture;

the valve inlet aperture and the valve outlet aperture have axes that are orthogonal to the axes of the truncate cone and the concave cone seat;

the truncate cone includes a valve plunger extended axially from a truncate end of the truncate cone;

the valve plunger is in sliding-seal contact with an inside periphery of a plunger sleeve;

a squeeze member is positioned proximate a terminal end of the valve plunger;

the truncate cone is spring-pressured in a direction of the squeeze member; and the valve outlet aperture includes predetermined configuration for directing flow of the molten wax from the valved extrusion nozzle.

14. The ergonomic wax pen of claim 13 wherein:

the predetermined configuration for directing flow of the molten wax from the valved extrusion nozzle includes the screw thread for attachment of predetermined application tips for directing the flow of the molten wax.

15. The ergonomic wax pen of claim 13 wherein:

the ergonomic case and the walls of the wax chamber are microwave tolerant for transferring microwave heat to the wax rod in the wax chamber.

16. The ergonomic wax pen of claim 13 wherein:

the walls of the wax chamber include electrical-resistance material for resistance heating the wax chamber to melt the wax rod; and the ergonomic case includes an electrical connection for transmission of electrical current to the electrical-resistance material from an electrical source.

17. The ergonomic wax pen of claim 13 wherein:

the wax chamber includes compressed-air space intermediate the piston and the base end of the wax chamber for containing an amount of air pressure from the source of compressed air for forcing the piston against the molten wax for extruding an amount of the molten wax from the wax chamber through the valved extrusion nozzle.

18. The ergonomic wax pen of claim 17 wherein:

the source of compressed air includes a hand pump having a spring-return piston that is attached to a pump plunger that can be engaged by the base plate on the source platform.

19. The ergonomic wax pen of claim 17 wherein:

the source of compressed air includes motorization that is remote from the source platform which has a pressure inlet to a valve chamber having a one-way valve to a plunger tube in communication with the one-way inlet valve for allowing remotely compressed air to enter the wax chamber by downward actuation of the base plate with downward pressure on the ergonomic case.

20. The ergonomic wax pen of claim 13 wherein:

the source of compressed air includes a pressure adapter for adapting a rate of flow of compressed air from a remote air compressor to a predetermined rate of flow of the compressed air for communication from the source platform to the wax chamber in a predetermined pressure conveyance.

21. The ergonomic wax pen of claim 20 wherein:

the source platform includes a current adaptor for adaptation and direction of electrical current for transmission from the electrical connection in a predetermined electrical conduit to a resistance heater which includes the helical wire surrounding the wax chamber.

22. The ergonomic wax pen of claim 21 wherein:

the pressure conveyance for conveyance of the compressed air to the wax chamber and the electrical conduit for transmission of electrical current to the resistance heater are sized, shaped and juxtaposed predeterminedly intermediate the source platform and the ergonomic case for ease and convenience of use of the ergonomic wax pen.

23. The ergonomic wax pen of claim 1 and further comprising:

a heat gauge in communication with heat of the molten wax in the wax chamber.

24. The ergonomic wax pen of claim 1 and further comprising:

a wax-level window linearly in the ergonomic case.

* * * * *